United States Patent [19]

Bage

[11] Patent Number: 4,653,607

[45] Date of Patent: Mar. 31, 1987

[54] SPEAKER SEAL

[75] Inventor: Jeffery T. Bage, Toledo, Ohio

[73] Assignee: American Motors Corporation, Southfield, Mich.

[21] Appl. No.: 807,295

[22] Filed: Dec. 10, 1985

[51] Int. Cl.[4] ..... H04R 7/22

[52] U.S. Cl. ..... 181/171; 181/141

[58] Field of Search ..... 181/171, 172, 141

[56] References Cited

U.S. PATENT DOCUMENTS 4,161,995 7/1979 Pohlmann et al. ..... 181/141 X 4,546,850 10/1985 Litner ..... 181/141

4,550,796 11/1985 Tomita ..... 181/141

*Primary Examiner*—Benjamin R. Fuller

*Attorney, Agent, or Firm*—Brooks & Kushman

[57] ABSTRACT

A speaker seal for mounting a speaker within an automobile wherein the speaker is suspended in an opening in a body panel located substantially parallel to and spaced from a substantially contiguous trim panel with a corresponding opening, comprises a tubular member coaxially extending around the opening in the body panel and the opening in the trim panel and resiliently compressed between the panels. The seal forms an acoustic barrier between sound waves emitted by the speaker through the trim panel opening from sound waves emitted on the other side of the speaker.

9 Claims, 5 Drawing Figures

Fig. 4
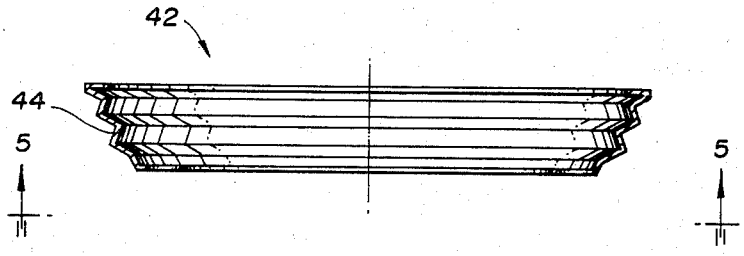
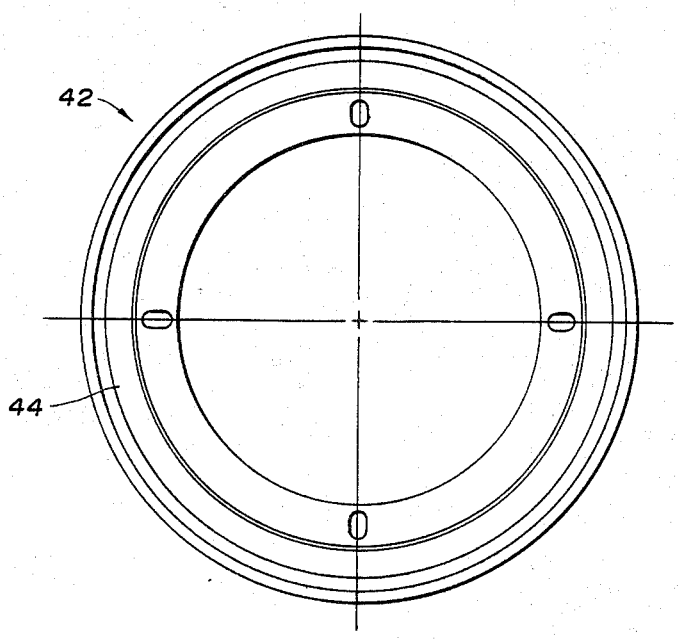
Fig. 5

SPEAKER SEAL

BACKGROUND OF THE INVENTION

I. Field of the Present Invention

This invention relates generally to acoustical barriers and more particularly to such a barrier mounted in an automobile between a body panel having an opening in which a speaker is suspended and a contiguous trim panel having a coaxial opening.

II. Background Art

Speakers produce sound by converting electrical energy into mechanical energy in the form of pressure waves hereinafter called sound waves. These waves are often created by the vibrating movement of a speaker cone, electrostatic panel, or the like. The speaker's vibrating surface typically has a face side and a rear side. The face side is designed to produce the audible sound that a listener hears and is placed in a mounting such that it directs sound waves toward the listening area. The rear side of the speaker's vibrating surface is on the other side or on the back of the face side. When the speaker is functioning, sound waves are generated on both the face side and the rear side of the speaker's vibrating member surface. Some cancellation of sound waves occur when waves generated on one side of the speaker's vibrating member are reflected to collide with waves generated on the other side of the speaker's vibrating member. This cancellation results in loss of certain frequencies and poor sound quality.

Speakers are mounted in automobiles in a number of ways. Typically, vibrating cone speakers extend through an opening in an automobile body panel so that the face is flush with the body panel. These speakers have a housing that includes radially extending mounting tabs having mounting apertures which register with mounting apertures in the body panel at the periphery of the body panel opening. Bolts are usually inserted through the registering apertures in the speaker housing and the periphery of the body panel opening and then fastened in place by nuts. In addition, a trim panel often covers the mounting panel for appearance sake and the trim panel must be provided with a corresponding opening to emit sound waves to the interior of the passenger compartment. Typically, the trim panel is spaced apart from the body panel and a portion of the sound waves are thereby emitted into the interspace between the panels. These sound waves can then be reflected by the panels and interfere with the sound waves emitted through the trim panel opening. The trim panel opening is often covered by a grill for the sake of appearance.

It has also been known to specially construct the speaker with a rigid grill housing that extends upwardly from the mounting panel to direct the sound waves from the speaker face through the trim panel opening. However, as frequently occurs, trim panels and body panels often have irregular surfaces or oversize openings. Furthermore, the trim panel is often spaced apart from the associated body panel such that both panels move relative to one another in a vibrating manner during operation of the automobile. Moreover, the distance between the panels can vary between different models of vehicles and even in different vehicles of the same model due to weather conditions, installation procedures, and the like. The previously known speaker housings are not well adapted to accommodate this wide range of panel variations. As a result, sound waves emitted from the rear side of the speaker can still collide with sound waves emitted from the speaker face, and can adversely affect the sound quality within the vehicle passenger compartment. Also, sound waves that reverberate between the two panels can escape through the opening in the trim panel and collide with sound waves emitted through the speaker grill. These conditions result in poor sound quality.

SUMMARY OF THE INVENTION

An object of the present invention is to provide a speaker seal for an automobile speaker which acts as an acoustic barrier between sound wave emitted from the face of the speaker and other reflected sound waves. In general, the seal coaxially surrounds the speaker and extends between a body panel and a contiguous trim panel whereby only sound wave emitted from the face of the speaker can be emitted through an opening in the trim panel. As a result, the overall sound quality in the passenger compartment of the automobile is improved as compared with conventional speaker mountings.

In carrying out the above object, the seal comprises a tubular member having a first axial end, a second axial end and means for resiliently urging the axial ends between a body panel having an opening in which a speaker is suspended and a contiguous trim panel having an opening through which the sound waves pass to the passenger compartment.

Preferably, the first and second axial ends of the tubular member have radially expanded flanges to form an expanded contact surface between the axial ends and the body and trim panels. The tubular member of the preferred embodiment comprises a resiliently deformable material generally known as open celled polyurethane polyether foam and the resiliency of this material is instrumental in assuring the aforesaid contact, although it is to be understood that other types of resilient materials can be used in forming the tubular member.

In the preferred construction, the speaker seal includes a means for securing an axial end of the tubular member about the speaker by the same mounting means which is used to suspend the speaker in the body panel. In the preferred embodiment, the speaker includes at least one radially extending flange with an abutment surface adapted to engage the body panel at the periphery of the body panel opening. In this construction, the radial flange includes apertures registering with the speaker mounting fasteners, whereby the seal can be mounted at the same time and with the same fasteners as are used to mount the speaker to the body panel.

The above object and other objects, features, and advantages of the present invention are readily apparent from the following detailed description of the best mode for carrying out the invention.

BRIEF DESCRIPTION OF THE DRAWINGS

The present invention will be more clearly understood by reference to the following detailed description of a preferred embodiment when read in conjunction with the accompanying drawing in which like reference characters refer to like parts throughout the views and in which:

FIG. 4 is a sectional view of a modified speaker seal constructed in accordance with the present invention; and FIG. 5 is a plan view of the alternative speaker seal shown in FIG. 4.

BEST MODE FOR CARRYING OUT THE INVENTION

Figure 2:
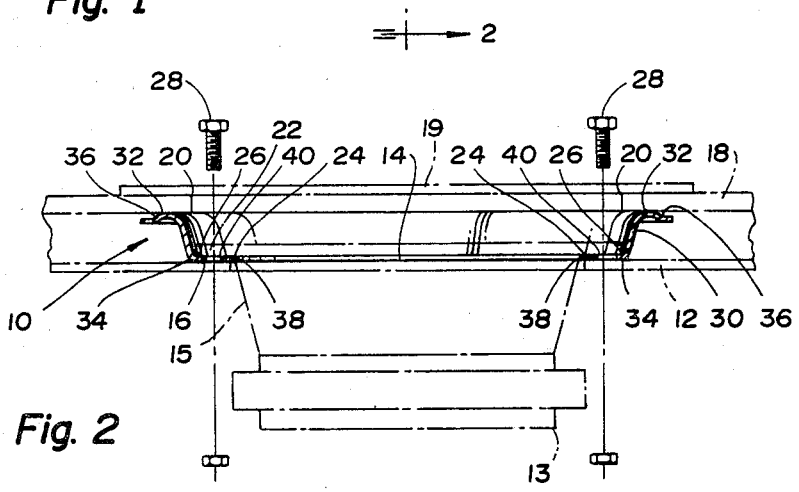
FIG. 2 is an elevational view showing the positioning of the speaker seal in the automobile environment.

Referring first to FIG. 2 of the drawing, a speaker seal constructed according to the present invention is generally indicated by reference numeral 10 and is positioned in an automobile between a body panel 12 and a contiguous trim panel 18 having an opening 20 coaxial with an opening 16 in the body panel 12. A speaker 13 having a front side 14 and a back side 15 is suspended in the opening 16 so that sound waves emitted from the front side 14 of the speaker are directed through the opening 20 into the passenger compartment of the vehicle. As can be seen, the trim panel 18 is substantially parallel to and spaced from the body panel 12.

The speaker 13 includes a housing or frame which has at least one radially extending abutment surface 22 which mates with the periphery of the body panel opening 16. This radially extending abutment surface 22 includes apertures 24 that register with apertures 26 in the body panel 12 and mounting bolts 28 are inserted through the apertures to fasten the speaker 13 to the body panel 12 at the periphery of the opening 16.

Figure 1:
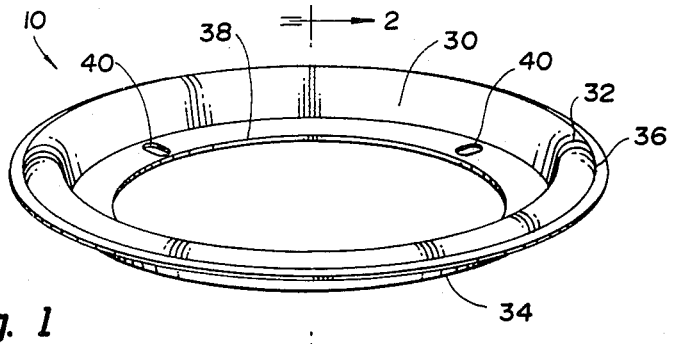
FIG. 1 is a perspective view of a speaker seal constructed in accordance with the present invention.
Figure 3:
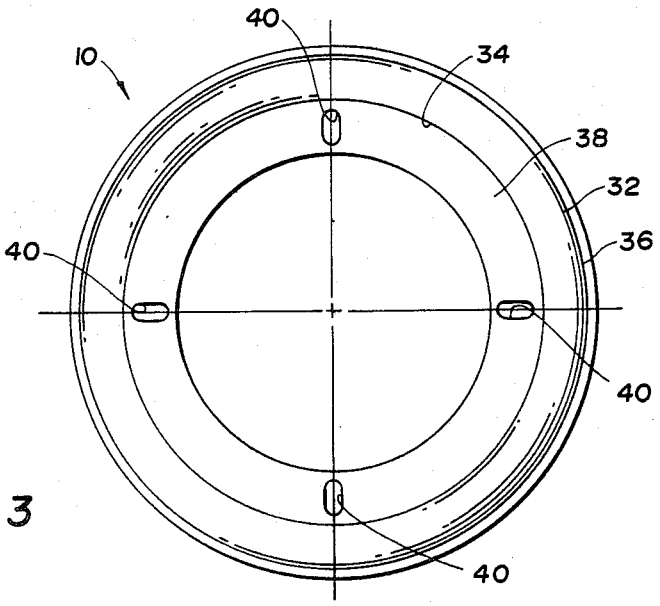
FIG. 3 is a plan view of the speaker seal shown in FIGS. 1 and 2.

As best shown in FIGS. 1 and 3, the speaker seal 10 comprises a tubular member 30 having a first axial end 32 and also having a second axial end 34. The first axial end 32 includes a radially expanded flange 36 extending outwardly from the tubular member 30 and the second axial end includes a radially extended flange 38 extending inwardly from the tubular member. These expanded flanges 36 and 38 are preferably continuous so that they provide an increased area of contact with the panels 16 and 18. However, it is to be understood that radially extended flange 38 can be made of a plurality of flange segments which can be sandwiched between the body panel 16 and the speaker abutment surface 22 apart from the mounting bolts 28. However, in the preferred embodiment, the continuous flange 38 includes mounting apertures 40 which register with the apertures 24 in the speaker 13 and the apertures 26 in the body panel 12. In this way, the mounting bolts 28 which are used to secure the speaker 13 in the body panel 12 are also used to connect the tubular member 30 to the body panel at the periphery of the opening 16, whereby the member 30 is mounted in coaxial alignment with and in connection to the speaker at the interface between the speaker front 14 and the speaker rear 15 as shown in FIG. 2.

Referring back to FIG. 2, the first axial end 32 of the tubular member 30 abuts against the trim panel 18 at the periphery of the opening 20 in the trim panel 18 and the second axial end 34 of the tubular member 30 abuts against the body panel 12 at the periphery of the opening 16. Preferably, the shape of each axial end of the tubular member 30 corresponds to the shape of the opening in the respective panel to which it abuts.

In addition, the axial ends 32 and 34 are maintained in contact with the panels 18 and 12 respectively, by a resilient means for urging the ends of the tubular member 30 axially outwardly from each other. Preferably, the means is integrally formed with the body of the tubular member 30. Thus, in the form of the invention shown in FIGS. 1–3, the speaker seal 10 comprises a resiliently deformable material known as open celled polyurethane polyether foam. Although other resiliently deformable materials could be used to make the speaker seal, such a material also creates an effective barrier to sound wave passage. In particular, an open celled polyurethane polyether foam having a density of 6 pounds per cubic foot is well adapted to provide these advantages. Thus, the speaker seal 10 forms an acoustic barrier which prevents the sound waves that are emitted from the back side 15 of the speaker 13 from reflecting and colliding with sound waves generated on the front side 14 of the speaker that pass into the vehicle passenger compartment.

FIGS. 4 and 5 illustrates a modification of the speaker seal 10 in which the means for resiliently urging the ends against the body and trim panels is again integrally formed with the seal body. However, a tubular member 44 is made of a resiliently deformable plastic which is constructed in the form of a corrugated body. The corrugated body 44 also urges the extended flanges 36 and 38 at the axial ends 32 and 34, respectively, into abutting engagement with the trim panel 18 and the body panel 12. Nevertheless, the seal 10 includes substantially the same structural features and other advantages of the seal 10 constructed with the tubular member 30 previously disclosed.

While the best mode for carrying out the invention has been described in detail, those familiar with the art to which this invention relates will recognize alternative ways of practicing the invention without departing from the scope and spirit of the present invention as defined by the following claims.

What is claimed is:

1. A speaker seal for a speaker having a front side and a back side mounted within an automobile wherein the speaker is suspended in an opening in a body panel, said panel being substantially parallel to and spaced from a substantially contiguous trim panel, said trim panel having an opening coaxial with the opening in said body panel, the speaker seal comprising:

a tubular member having a first axial end and a second axial end;

means for supporting said tubular member in coaxial alignment with and in connection to the speaker at the interface of said front side and said back side; and a means for resiliently urging said first axial end axially outward from said second axial end, whereby said first axial end of said member abuts against the trim panel and said second axial end of said member abuts against said body panel and forms an acoustic barrier between pressure waves emitted by the speaker toward the trim panel and the pressure waves emitted by the speaker away from the trim panel.

2. A speaker seal as defined in claim 1 wherein said means for supporting comprises seal means for sealing said member to said speaker at said body panel.

3. A speaker seal as defined in claim 1 wherein said tubular member includes a radially extended flange on each said axial end of said member.

4. A speaker seal as defined in claim 2 wherein said sealing means comprises a continuous radial flange on said second axial end of said member extending inwardly toward the axis of the member.

5. A speaker seal as defined in claim 4 wherein the speaker includes at least one radially extending abutment surface adapted to engage the body panel at the periphery of its opening and wherein said radial flange registers with the radially extending abutment surface of the speaker.

6. A speaker seal as defined in claim 5 wherein the abutment surface of the speaker and said radial flange include registering apertures.

7. A speaker seal as defined in claim 1 wherein said tubular member is made of a resiliently deformable material.

8. A speaker seal as defined in claim 7 wherein said resiliently deformable material is open cell polyurethane polyether foam.

9. A speaker seal as defined in claim 8 wherein said foam comprises open cell polyurethane polyether foam of 6 pounds per cubic feet density.

* * * * *